US010125773B2

(12) United States Patent
Hiradate et al.

(10) Patent No.: US 10,125,773 B2
(45) Date of Patent: Nov. 13, 2018

(54) CENTRIFUGAL FLUID MACHINE

(71) Applicant: Hitachi, Ltd., Tokyo (JP)

(72) Inventors: Kiyotaka Hiradate, Tokyo (JP); Yasushi Shinkawa, Tokyo (JP); Satoshi Joko, Tokyo (JP); Toshio Ito, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 991 days.

(21) Appl. No.: 14/358,297

(22) PCT Filed: Nov. 9, 2012

(86) PCT No.: PCT/JP2012/079121
§ 371 (c)(1),
(2) Date: May 15, 2014

(87) PCT Pub. No.: WO2013/073469
PCT Pub. Date: May 23, 2013

(65) Prior Publication Data

US 2014/0314557 A1 Oct. 23, 2014

(30) Foreign Application Priority Data

Nov. 17, 2011 (JP) ..... 2011-251213

(51) Int. Cl.
*F04D 17/10* (2006.01)
*F04D 29/28* (2006.01)
(Continued)

(52) U.S. Cl.
CPC ..... *F04D 17/10* (2013.01); *F04D 29/284* (2013.01); *F04D 29/30* (2013.01); *F04D 29/681* (2013.01); *F05D 2250/38* (2013.01)

(58) Field of Classification Search
CPC ..... F04D 17/10; F04D 29/284; F04D 29/30; F04D 29/681; F05D 2250/38
See application file for complete search history.

(56) References Cited

U.S. PATENT DOCUMENTS 3,363,832 A 1/1968 Groff
5,639,217 A * 6/1997 Ohtsuki ..... F04D 29/284 416/183
(Continued)

FOREIGN PATENT DOCUMENTS

CN 1288506 A 3/2001
GB 2337795 A 12/1999
(Continued)

OTHER PUBLICATIONS

Chinese Office Action received in corresponding Chinese Application No. 201280056349.6 dated Nov. 2, 2016.
(Continued)

*Primary Examiner* — Matthew W Jellett
*Assistant Examiner* — Christopher Ballman
(74) *Attorney, Agent, or Firm* — Mattingly & Malur, PC

(57) ABSTRACT

In a centrifugal fluid machine, the secondary flow loss inside an impeller is reduced and the occurrence, when the flow rate decreases, of a flow separation/stall on the shroud-side suction surface near the leading edge of each impeller blade is suppressed, thereby making it possible to maintain the operating range of the impeller. For this, at the trailing edge of each impeller blade, the trailing edge of each impeller blade is inclined so that the shroud side of the impeller blade is positioned more backward in the rotation direction than the hub side thereof as the impeller is seen from the suction direction upstream of the rotary shaft of the impeller. Also, out of two adjacent impeller blades, the shroud side of one impeller blade trailing the other impeller blade in the impeller rotation direction overlaps with the other impeller blade at around the leading edge of the one impeller blade.

11 Claims, 14 Drawing Sheets

(51) Int. Cl.
*F04D 29/30* (2006.01)
*F04D 29/68* (2006.01)

(56) References Cited

U.S. PATENT DOCUMENTS

| | | | | | |
|---|---|---|---|---|---|
| 5,685,696 | A * | 11/1997 | Zangeneh | F01D 5/048 | 416/186 R |
| 5,730,582 | A | 3/1998 | Heitmann | | |
| 6,062,819 | A * | 5/2000 | Zangeneh | F04D 29/2205 | 415/181 |
| 6,135,716 | A * | 10/2000 | Billdal | F03B 3/125 | 416/183 |
| 6,338,610 | B1 | 1/2002 | Harada et al. | | |
| 8,475,131 | B2 * | 7/2013 | Shibata | F04D 29/284 | 416/182 |
| 2017/0342993 | A1 * | 11/2017 | Yoshida | F04D 27/001 | |

FOREIGN PATENT DOCUMENTS

| | | | |
|---|---|---|---|
| JP | 2701604 | B2 | 10/1997 |
| JP | 2730396 | B2 | 12/1997 |
| JP | 2002-332991 | A | 11/2002 |
| JP | 3693121 | B2 | 7/2005 |
| WO | 95/34744 | A1 | 12/1995 |
| WO | 99/36701 | A1 | 7/1999 |
| WO | 2012/072996 | A1 | 6/2012 |

OTHER PUBLICATIONS

Extended European Search Report received in corresponding European Application No. 12850331.5 dated May 20, 2015.

* cited by examiner (a) AT TRAILING EDGE OF BLADE, SHROUD SIDE IS FORWARDLY INCLINED MORE THAN HUB SIDE IN ROTAION DIRECTION (b) AT TRAILING EDGE OF BLADE, SHROUD SIDE IS REARWARDLY INCLINED MORE THAN HUB SIDE IN ROTAION DIRECTION (a)

(b) IMPELLER INLET VELOCITY TRIANGLE (a) HUB-SIDE TRAILING EDGE IS BEHIND SHROUD-SIDE TRAILING EDGE IN ROTATION DIRECTION (b) HUB-SIDE TRAILING EDGE IS AHEAD OF SHROUD-SIDE TRAILING EDGE IN ROTATION DIRECTION

CENTRIFUGAL FLUID MACHINE

TECHNICAL FIELD

The present invention relates to a centrifugal fluid machine having a centrifugal impeller and, more specifically, to the shape of a centrifugal impeller blade.

BACKGROUND ART

Centrifugal fluid machines each having a centrifugal rotary impeller have been used in various plants, air-conditioning machines and liquid pressure-feed pumps. With the demand for environmental burden reduction growing higher in recent years, the centrifugal fluid machines are required to achieve higher efficiency and wider operating ranges than before.

An example of existing type of centrifugal fluid machine will be described in the following using FIG. 15. FIG. 15 is a sectional view on a plane crossing an impeller rotary axis of an existing type of centrifugal fluid machine. The existing type of centrifugal fluid machine mainly includes a centrifugal impeller 1 for providing a fluid with energy by means of rotation, a rotary shaft 2 for rotating the impeller, a diffuser 3 which, being located radially outside the impeller 1, converts the dynamic pressure of the fluid flowing in through the outlet of the impeller into a static pressure, and a return channel 4 which, being located downstream of the diffuser 3, leads the fluid to a downstream flow path 6. The impeller 1 is composed of a disk (hub) 11 coupled to a main shaft, a side plate (shroud) 12 facing the hub 11, and plural blades 13 circumferentially arranged between the hub 11 and the shroud 12. There are also cases in which an impeller having no shroud is used. The diffuser 3 is either a vaned diffuser having plural circumferentially arranged blades or a vaneless diffuser.

In the above centrifugal fluid machine, fluid is sucked in through an impeller inlet 5 and has its pressure increased by passing through the impeller 1, diffuser 3, and return channel 4 to be then led to the downstream flow path 6.

For efficiency enhancement of a centrifugal fluid machine, an impeller plays a very important role. To enhance the efficiency of an impeller, it is necessary to reduce losses such as friction loss generated on a wall surface when fluid flows inside the impeller, deceleration loss generated when the relative velocity of the fluid flowing in the impeller, from the impeller inlet toward the impeller outlet, decreases causing the boundary layer thickness of the flow near the wall surface to increase, and secondary flow loss generated when low velocity, low energy fluid flowing near the wall surface is driven by static pressure gradients in sectional planes perpendicularly intersecting with the main flow direction in the impeller.

Various methods have been proposed to reduce the secondary flow loss among the above-mentioned losses. PTL 1 listed in the following, for example, introduces an example method for reducing the secondary flow loss. In the method, the blade loading distribution on an impeller included in a centrifugal fluid machine is studied; the blade loading on the shroud side is made to concentrate on the leading edge side of each blade, and the blade loading on the hub side is made to concentrate on the trailing edge side of each blade, thereby reducing the static pressure difference between the hub and the shroud near the suction surface at the trailing edge on the shroud side of each blade (see FIG. 16 being described later) where fluid with low energy in particular tends to accumulate.

There are also examples like those described in PTL 1 to PTL 3 listed in the following in which the secondary flow loss is reduced by circumferentially inclining each blade such that, in a trailing edge portion of each blade, the hub side is ahead of the shroud side in the direction of impeller rotation. By shaping the trailing edge portion of each blade like this, the effect as illustrated in FIG. 16 (*b*) can be obtained. In FIG. 16, two adjacent blades of an impeller are shown with the shroud omitted. Blade force F applied from a pressure surface 14 of each blade 13 (leading-side surface of each blade in the direction of impeller rotation) to the fluid flowing in the impeller is directed perpendicularly to the pressure surface 14 of each blade. Therefore, in an impeller in which, as shown in FIG. 16 (*a*), each blade is inclined in a trailing edge portion thereof to be opposite to the blade inclination proposed in PTL 1 to PTL 3 (i.e. when the hub side of each blade is, in a trailing edge portion 17 thereof, behind the shroud side thereof in the direction of impeller rotation), the static pressure on the hub-side pressure surface 141 of each blade normally increases. This static pressure, however, decreases when each blade of the impeller is shaped as shown in FIG. 16 (*b*). On the other hand, the static pressure on the shroud-side suction surface 151 of each blade that normally decreases when each blade is shaped as shown in FIG. 16 (*a*) increases when each blade is shaped as shown in FIG. 16 (*b*). Therefore, the secondary flow that is, when each blade is shaped as shown in FIG. 16 (*a*), formed to accumulate low-energy fluid on the shroud-side suction surface 151 is suppressed when each blade is shaped as shown in FIG. 16 (*b*). The secondary flow loss is thus reduced.

CITATION LIST

Patent Literature

Patent Literature 1: Japanese Patent No. 3693121
Patent Literature 2: Japanese Patent No. 2701604
Patent Literature 3: Japanese Patent No. 2730396

SUMMARY OF INVENTION

Technical Problem

However, when each blade is circumferentially inclined such that, in a trailing edge portion thereof, the hub side of the blade is ahead of the shroud side of the blade in the direction of impeller rotation as described in Patent Literature 1 to PTL 3, the static pressure sharply rises, as noted in FIG. 16 (*b*), on the shroud-side suction surface 151 in the direction of flow from the leading edge 16 of the blade. Therefore, the adverse static pressure gradient in the flow direction becomes large particularly on the shroud-side suction surface of each blade where the relative fluid velocity largely decreases. This causes a flow separation/stall to occur on a large flow-rate side particularly at around the leading edge of the shroud-side suction surface of each blade, resulting in narrowing the operating range of the impeller.

The present invention has been made to solve the above problem with the existing technique and an object of the present invention is to provide a centrifugal fluid machine having an impeller which makes it possible to inhibit, when the flow rate decreases, the occurrence of a flow separation/stall on a shroud-side suction surface at around the leading edge of each blade of the impeller to maintain the operating range of the impeller while reducing the secondary flow loss in the impeller.

Solution to Problem

To solve the above problem, a centrifugal fluid machine according to the present invention has a centrifugal impeller in which, when the impeller is seen from upstream of a rotary shaft of the impeller (a suction direction), a trailing edge of each impeller blade is inclined so that a shroud side of the impeller blade is positioned more backward in a rotation direction than a hub side thereof and in which, out of two adjacent impeller blades, the shroud side of one impeller blade trailing the other impeller blade in an impeller rotation direction overlaps with the other impeller blade at around a leading edge of the one impeller blade.

Also, the centrifugal fluid machine has a centrifugal impeller in which a shroud diameter at leading edges of impeller blades is larger than a hub diameter at the leading edges of the impeller blades, in which, when the impeller is seen from the suction direction, the trailing edge of each impeller blade is inclined so that the shroud side of the impeller blade is positioned more backward in the rotation direction than the hub side thereof, and, furthermore, in which the shroud side at the leading edge of each impeller blade is, with respect to a line radially extending from a rotation center of the impeller, aligned with or ahead of the hub side at the leading edge of the each impeller blade in the rotation direction.

Also, the centrifugal fluid machine has a centrifugal impeller in which, when the impeller is seen from the suction direction, the trailing edge of each impeller blade is inclined so that the shroud side of the impeller blade is positioned more backward in the rotation direction than the hub side thereof and in which an incidence angle to the impeller is 0° or less at a specified point.

Also, the above centrifugal fluid machines each have an impeller in which an angle (rake angle) defined to be positive in a direction of impeller rotation reaches a maximum value between the leading edge of each impeller blade and a middle point of the impeller blade in a flow direction and, after reaching the maximum value, decreases on a downstream side to be in a range of −5° to −35° at an impeller outlet, the rake angle being an angle formed between a plane (meridian plane) which crosses a rotation center of the impeller to be parallel to the rotary shaft of the impeller and a line which connects a point between a leading edge and a trailing edge of the hub on the meridian plane and a point between a leading edge and a trailing edge of the shroud on the meridian plane, the two points accounting for a same ratio in terms of their positions between the leading edge and the trailing edge of the hub and between the leading edge and the trailing edge of the shroud, respectively.

Advantageous Effects of Invention

According to the present invention, a centrifugal fluid machine including an impeller having adequate strength and manufacturability can be provided in which it is possible to, while reducing the secondary flow loss in the impeller, inhibit, when the flow rate decreases, the occurrence of a flow separation/stall on the shroud-side suction surface at around the leading edge of each impeller blade and to, thereby, maintain the operating range of the impeller.

DESCRIPTION OF EMBODIMENTS

Examples of the present invention will be described below with reference to drawings. In the following description, a centrifugal fluid machine refers to, for example, a centrifugal blower or a centrifugal compressor.

Example 1

In the following, a first embodiment of the present invention will be described in detail with reference to drawings.

Figure 1:
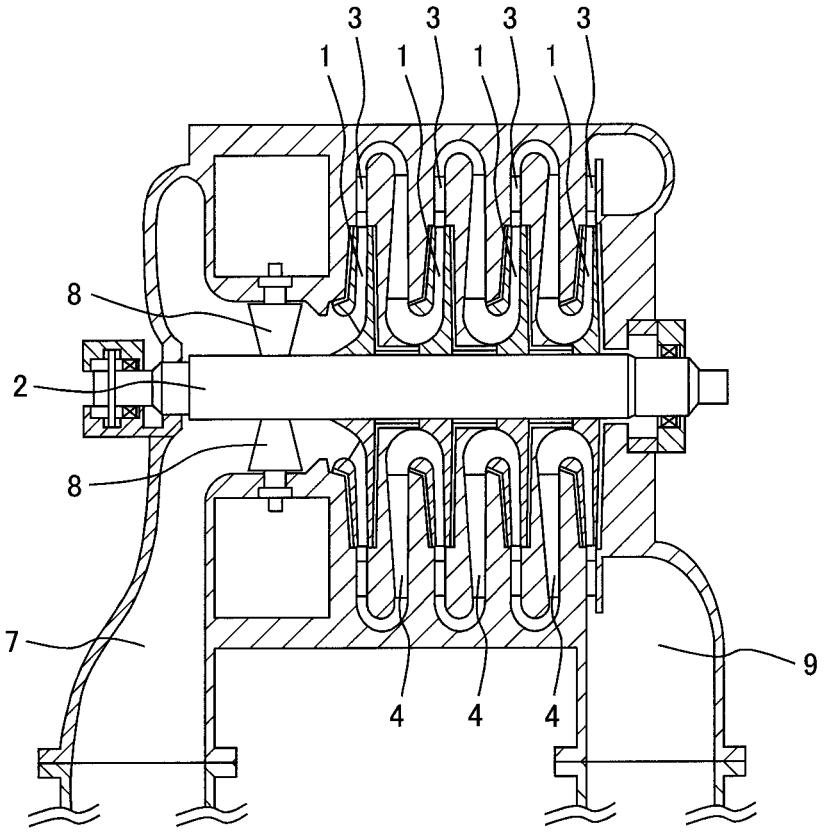
FIG. 1 is a sectional view of the centrifugal fluid machine according to a first example of the present invention, taken on a plane crossing the rotary shaft of the impeller included in the centrifugal fluid machine.
Figure 15:
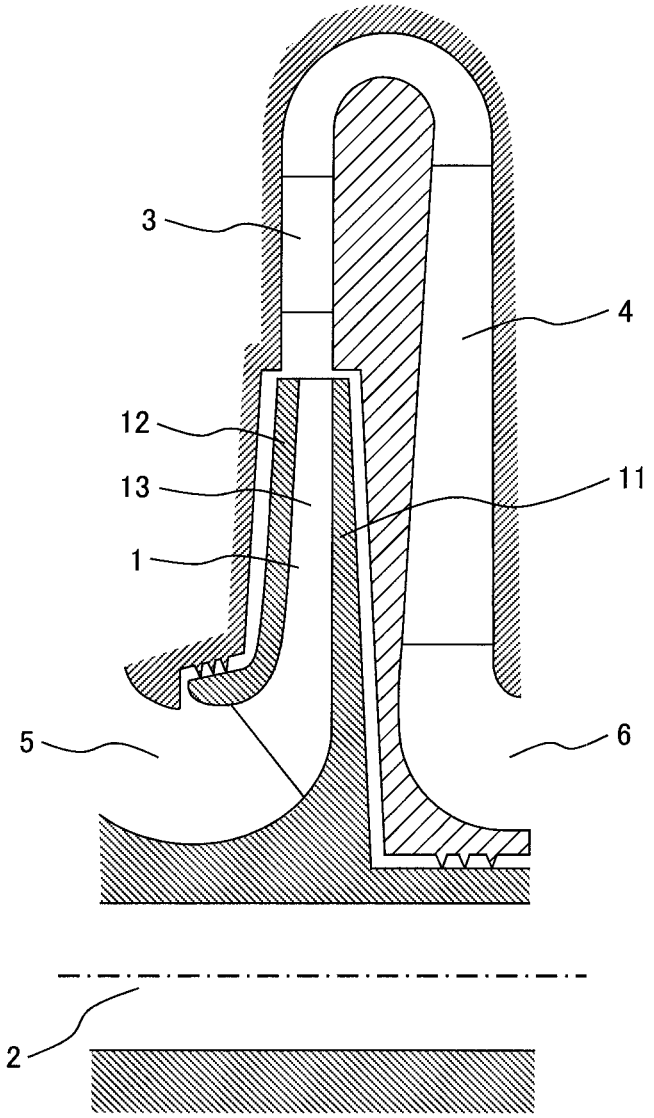
FIG. 15 is a sectional view on a plane parallel to the rotary shaft of the impeller included in an existing type of centrifugal fluid machine.
Figure 16:
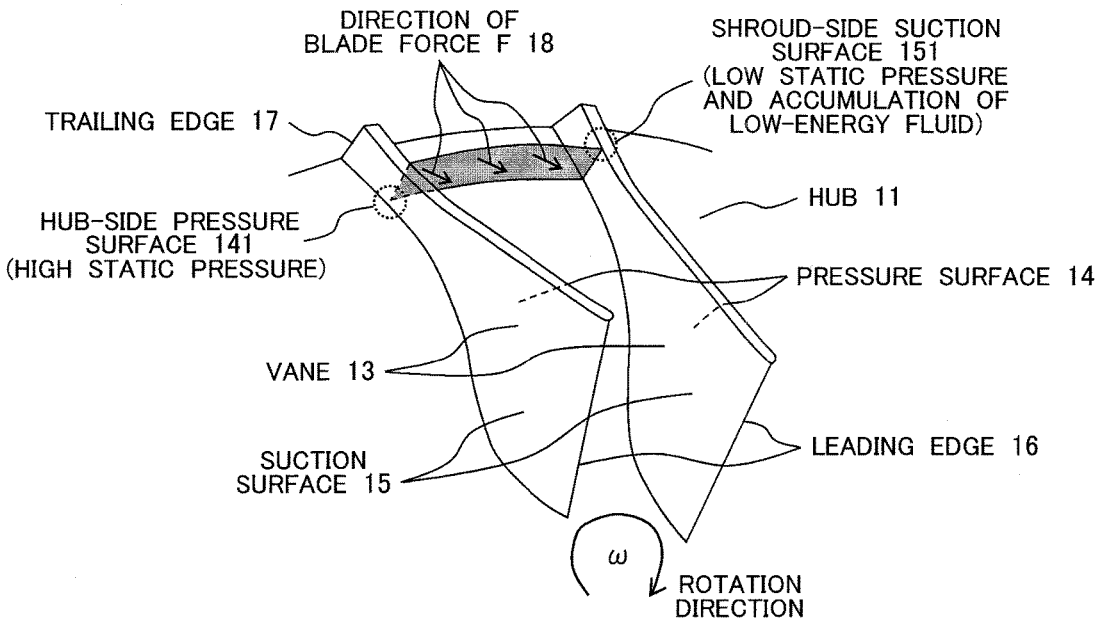
FIG. 16 shows, with the shroud omitted, impeller blades included in an impeller for explaining the direction of blade force applied to the fluid flowing between two adjacent blades and the characteristic of static pressure distribution along an inter-blade sectional plane.
Figure 16:
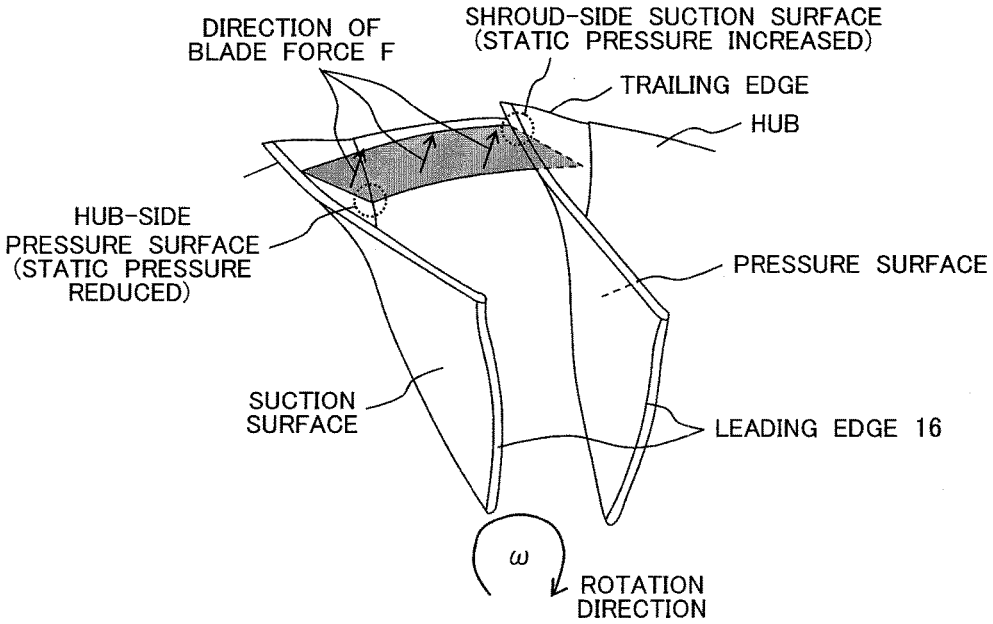

The constituent elements of the centrifugal fluid machine of the present example mainly include, like the existing type of centrifugal fluid machine shown in FIG. 15, a centrifugal impeller 1 for providing a fluid with energy by means of rotation, a rotary shaft 2 for rotating the impeller, a diffuser 3 which, being located radially outside the impeller, converts the dynamic pressure of the fluid flowing in through the outlet of the impeller into a static pressure, and a return channel 4 which, being located downstream of the diffuser 3, leads the fluid to a downstream flow path. The impeller 1 is composed of a disk (hub) 11 coupled to a main shaft 2, a side plate (shroud) 12 facing the hub 11, and plural blades 13 circumferentially arranged between the hub 11 and the shroud 12. There are also cases in which an open impeller having no shroud is used. The diffuser 3 is either a vaned diffuser having plural circumferentially arranged blades or a vaneless diffuser. Even though the centrifugal fluid machine shown in FIG. 15 has a single-stage structure, the centrifugal fluid machine may be provided, as shown in FIG. 1, with a suction casing 7 located upstream of the impeller suction inlet to guide the fluid from the upstream piping and inlet guide vanes 8 for pre-whirling the fluid sucked in by the impeller. There are also cases in which, as shown in FIG. 1, the centrifugal fluid machine has a multi-stage structure with each stage composed of a combination of an impeller 1, a diffuser 3, and a return channel 4. Furthermore, there are also cases in which, as shown in FIG. 1, a discharge casing 9 is provided at a return channel outlet located on the most downstream side. Note that, in the present specification, the centrifugal fluid machine refers to, for example, a centrifugal blower or a centrifugal compressor.

Figure 2:
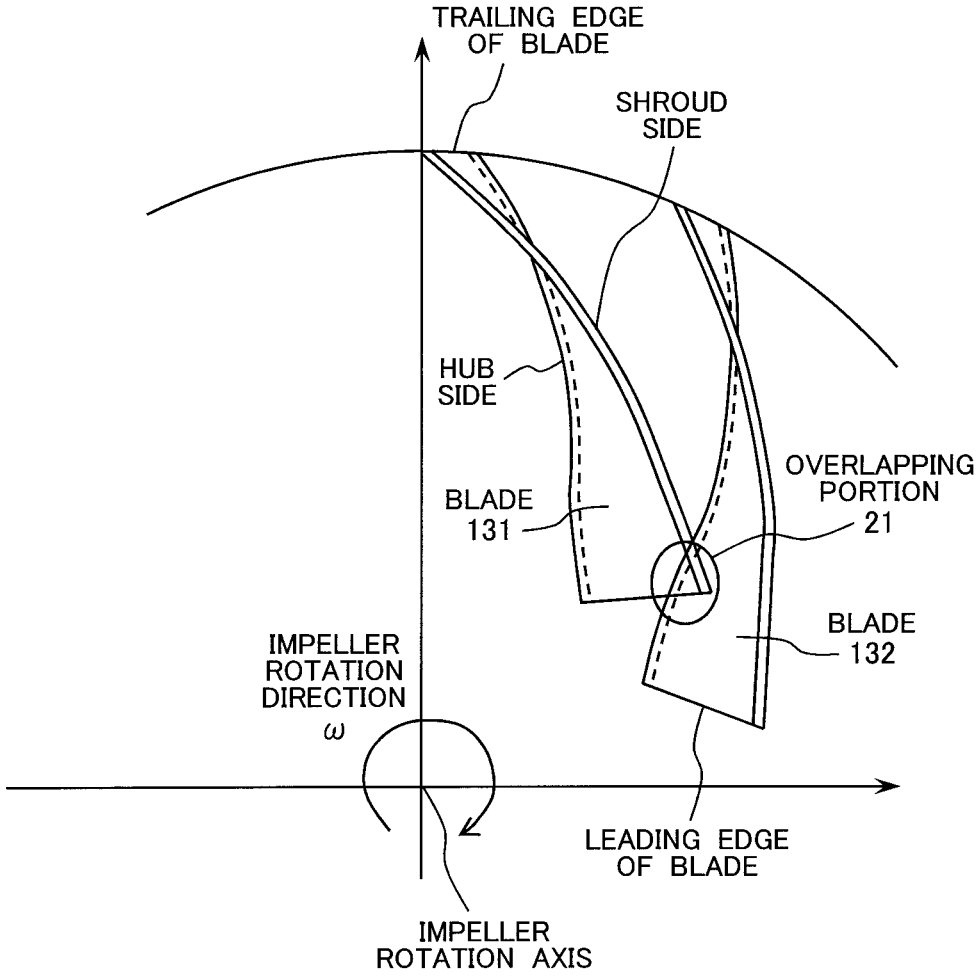
FIG. 2 shows the impeller included in the centrifugal fluid machine according to the first example of the present invention as seen from upstream of the rotary shaft of the impeller (as seen from the suction direction).

In the present example, the centrifugal fluid machine is structured such that, when the impeller is seen from the upstream side (suction side) along the rotary shaft as shown in FIG. 2, the trailing edge of each impeller blade is inclined so that the shroud side of the impeller blade is positioned more backward in the rotation direction than the hub side thereof at around the trailing edge of the impeller blade and such that, between two adjacent blades, the shroud side of a blade 131 following a blade 132 in the impeller rotation direction has, at around the leading edge thereof, an overlapping portion 21 overlapping with the preceding blade 132.

In the above structure with the trailing edge of each impeller blade is inclined so that the shroud side of the impeller blade is positioned more backward in the rotation direction than the hub side thereof at around the trailing edge of the impeller blade, the direction of blade force applied to the fluid changes, as descried in the foregoing, to vary the static pressure distribution between blades. As a result, a secondary flow normally formed to cause low-energy fluid accumulation on the shroud-side suction surface of each blade is suppressed and, therefore, the secondary flow loss can be reduced.

Figure 3:
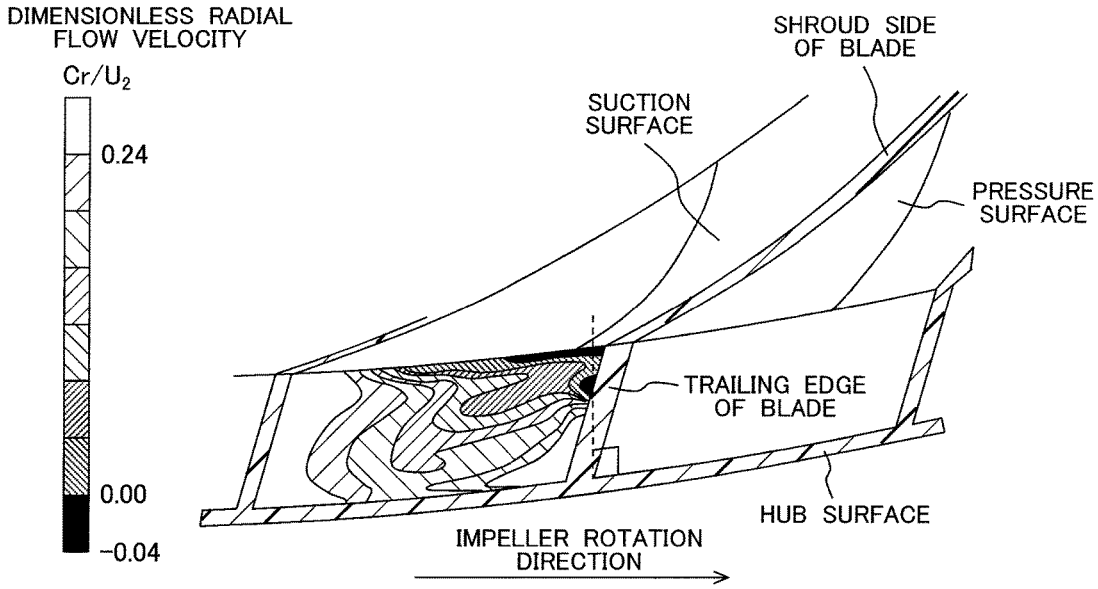
FIG. 3 shows radial flow velocity distributions at impeller outlets determined by conducting three-dimensional fluid analysis both on an existing type of centrifugal fluid machine and on the centrifugal fluid machine according to the first example of the present invention.
Figure 3:
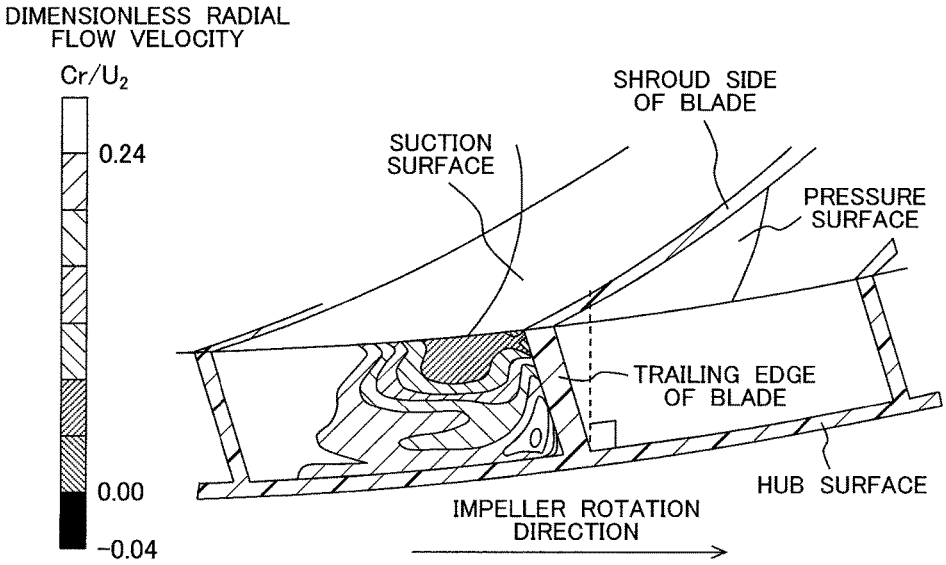

FIGS. 3 (*a*) and 3 (*b*) each show a distribution of radial velocity Cr at the impeller outlet determined by conducting three-dimensional fluid analysis with FIG. 3 (*a*) representing a case in which the trailing edge of each impeller blade is inclined so that the shroud side of the impeller blade is positioned more forward in the rotation direction than the hub side and FIG. 3 (*b*) representing a case in which the trailing edge of each impeller blade is inclined so that the shroud side of the impeller blade is positioned more backward in the rotation direction than the hub side. The radial velocity Cr has been made dimensionless using blade outlet peripheral velocity $U_2$ (=blade outlet radius $R_2$×impeller angular velocity ω). In FIG. 3 (*a*), reverse flow areas generated by the accumulation of low-energy fluid caused by the secondary flow are shown in black near the shroud-side suction surface of the blade. FIG. 3 (*b*), on the other hand, shows a state in which the flow appears uniform with the reverse flow areas shown in FIG. 3 (*a*) having disappeared.

Figure 4:
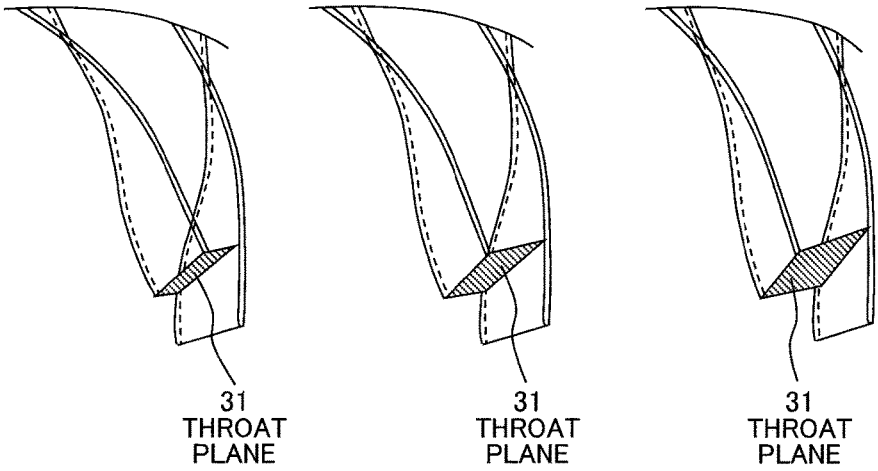
FIG. 4 is a diagram for explaining the overlapping portion between two adjacent blades included in an impeller of a centrifugal fluid machine.

Next, with reference to FIG. 4, the effect of forming an overlapping portion between adjacent blades such that the shroud side of a blade following a preceding blade in the impeller rotation direction overlaps, at around the leading edge thereof, with the preceding blade will be described. FIG. 4 schematically shows three pairs of adjacent centrifugal impeller blades with overlapping portions gradually varied in size between them. In the representation of each of the three pairs of blades, the hatched area represents a throat plane 31 which is an blade-to-blade passage sectional plane defined as being associated with the smallest inter-blade distance measured in leading edge portions along the flow direction of the two blades and which represents the smallest blade-to-blade passage sectional area. FIG. 4 indicates that gradually reducing the size of the overlapping portion gradually enlarges the blade-to-blade passage sectional area typically represented by the throat plane.

Normally, the relative velocity of the fluid flowing inside a centrifugal impeller is the highest at the leading edge of each blade and gradually decreases toward downstream as the radius and, hence, the blade-to-blade passage sectional area increases. When, as in the case of the rightmost pair of blades shown in FIG. 4, there is no overlapping portion between adjacent blades, the rate of increase in the blade-to-blade passage sectional area becomes large in the impeller, particularly in a forward part of each blade where a flow separation/stall tends to occur, and this causes the relative velocity along the main flow direction inside the impeller to sharply decrease. Hence, the adverse static pressure gradient in the main flow direction also increases. Furthermore, in the present example, inclining the trailing edge of each impeller blade so that the shroud side of the impeller blade is positioned more backward in the rotation direction than the hub side thereof also causes, as described above, the adverse static pressure gradient in the flow direction to increase on the shroud-side suction surface of the blade. Thus, when no overlapping portion is provided between adjacent blades, the above described effects are combined to cause a flow separation/stall on the large flow-rate side of the shroud-side suction surface of each blade. As a result, the operating range of the impeller is narrowed.

When, on the other hand, there is an overlapping portion between adjacent blades as in the case of the leftmost pair of blades shown in FIG. 4, the rate of increase in the blade-to-blade passage sectional area in a forward part of each blade can be held low. Therefore, even with the trailing edge of each impeller blade inclined so that the shroud side of the impeller blade is positioned more backward in the rotation direction than the hub side thereof near the trailing edge of the blade, the decrease in the relative velocity in the main flow direction in the impeller can be suppressed. As a result, the adverse static pressure gradient in the flow direction on the shroud-side suction surface of the blade can be reduced.

Figure 5:
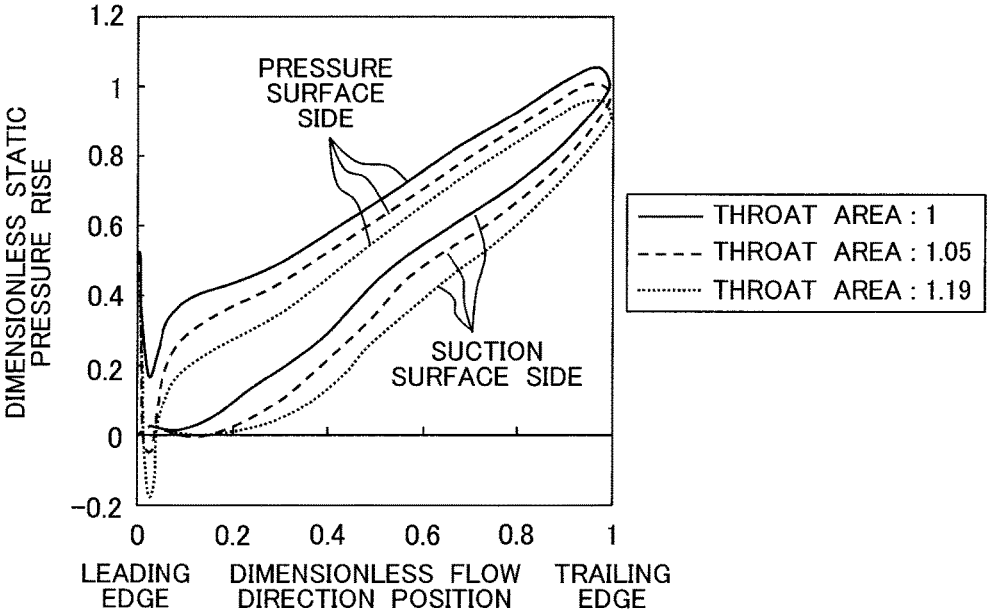
FIG. 5 shows static pressure distributions in the flow direction on blade surfaces determined by conducting three-dimensional fluid analysis on centrifugal fluid machines differing in the size of the overlapping portion between two adjacent blades.

FIG. 5 compares distributions in the flow direction of static pressure values on the surface on the shroud side of each blade determined by conducting three-dimensional fluid analysis on three cases mutually differing, as shown in FIG. 4, in the size of the overlapping portion between adjacent blades. The horizontal axis represents the dimensionless flow direction position with 0 representing the leading edge of each impeller blade and 1 representing the trailing edge of each impeller blade. The vertical axis represents the dimensionless static pressure rise on the blade surface at each dimensionless flow direction position relative to the static pressure value at the leading edge of each blade. The dimensionless static pressure rise has been determined using dynamic pressure $\frac{1}{2}\rho U_2^2$ ($\rho$=density) based on impeller outlet peripheral velocity $U_2$. In FIG. 5, relative to a throat area value of 1 for the impeller with the largest overlapping portion between blades, throat area values for other two impellers each with a smaller overlapping portion between blades are indicated. From FIG. 5, it is known that, as the overlapping portion between two adjacent blades becomes smaller (as the throat area becomes larger), the gradient of the static pressure-rise in the flow direction increases on the suction surface side of each blade, particularly, in a forward part of the blade, resulting in a severer adverse pressure gradient. Hence, when the overlapping portion between two adjacent blades is larger, it is more possible to keep low the static adverse pressure gradient in the main flow direction in a forward part of each blade, so that the operating range of the centrifugal fluid machine can be maintained or enlarged.

Figure 6:
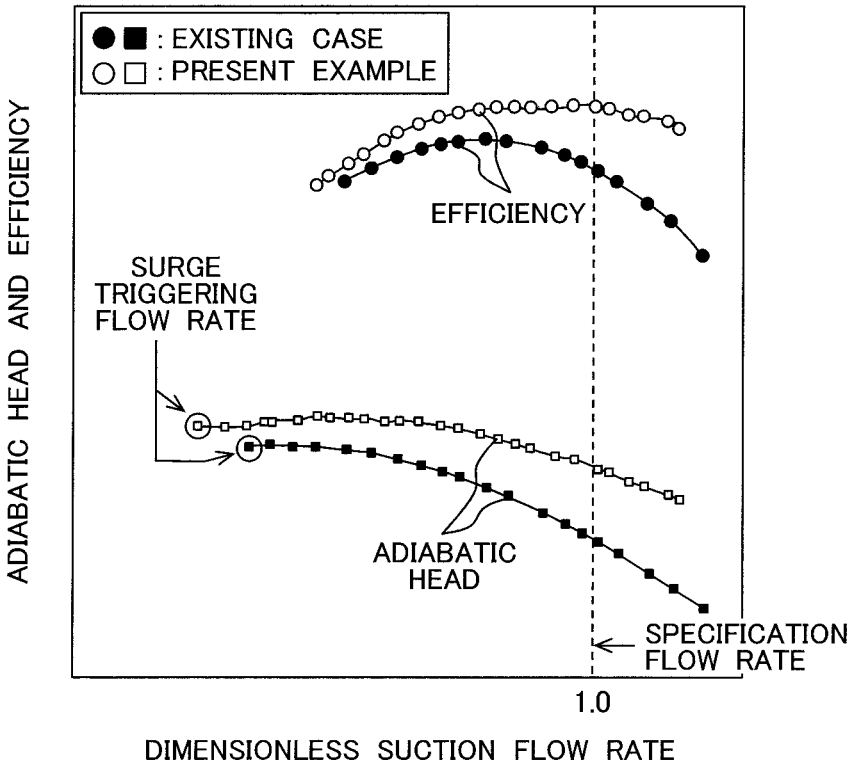
FIG. 6 compares performance test results on an existing type of centrifugal fluid machine and on the centrifugal fluid machine according to the first example of the present invention.

In FIG. 6, performance test results on an existing type of centrifugal fluid machine and on the centrifugal fluid machine of the present example are compared. The horizontal axis represents the dimensionless flow rate based on a specification flow rate of 1. The vertical axis represents adiabatic head and efficiency. The lowest flow rate point of the adiabatic head curve, i.e. the leftmost point of the adiabatic head curve represents a flow rate at which surging occurs causing large pressure pulsation in the centrifugal fluid machine and making the centrifugal fluid machine inoperable. The performance tests were conducted using single-stage centrifugal fluid machines prepared by combining each of an existing type of impeller and the impeller of the present example with a vaned diffuser and a return channel both designed to match the impeller. From FIG. 6, it is known that, compared with the existing type of centrifugal fluid machine, the centrifugal fluid machine of the present example has been improved in terms of both efficiency and operating range.

The centrifugal fluid machine of the present example may include an impeller which also has features described in connection with a second example being described later, namely such that the shroud diameter at the leading edges of the blades is larger than the hub diameter at the leading edges of the blades and such that, when the impeller is seen from a suction direction, the shroud side of each impeller blade is, at the trailing edge of the impeller blade, rearwardly inclined in the rotation direction more than the hub side thereof whereas, at the leading edge of each impeller blade and with respect to a line radially extending from the rotation center of the impeller, the shroud side of the impeller blade is aligned with or ahead of the hub side thereof in the rotation direction. In this way, even with the trailing edge of each impeller blade inclined so that the shroud side of the impeller blade is positioned more backward in the rotation direction than the hub side thereof around the trailing edge of the impeller blade, it is possible to further reduce the static adverse pressure gradient on the shroud-side suction surface of the blade in the main flow direction in the impeller. This will be described in detail in connection with the second example later.

In the centrifugal fluid machine of the present example, each impeller blade is greatly inclined in the circumferential direction as shown in FIG. 2. Therefore, a large bending stress occurs particularly at a leading edge portion of each blade which starts shoving the fluid before other portions of the blade and also at around the root of each blade in a trailing edge portion thereof where the trailing edge of each impeller blade is inclined so that the shroud side of the impeller blade is positioned more backward in the rotation direction than the hub side thereof. Also, inclining the trailing edge of each impeller blade to an excessive extent so that the shroud side of the impeller blade is positioned more backward in the rotation direction than the hub side thereof makes impeller fabrication very difficult. It is, therefore, necessary to determine an appropriate degree of impeller blade inclination.

For the centrifugal fluid machine of the present example, the rake angle formed between a meridian plane and a blade element is defined to be positive in the impeller rotation direction, and a maximum rake angle is set to occur between the leading edge of each blade and a middle point of the blade in the flow direction and to decrease, after reaching the maximum value, on the downstream side to be eventually in the range of −5° to −35° at the impeller outlet. This will be described in more detail in the following.

Figure 7:
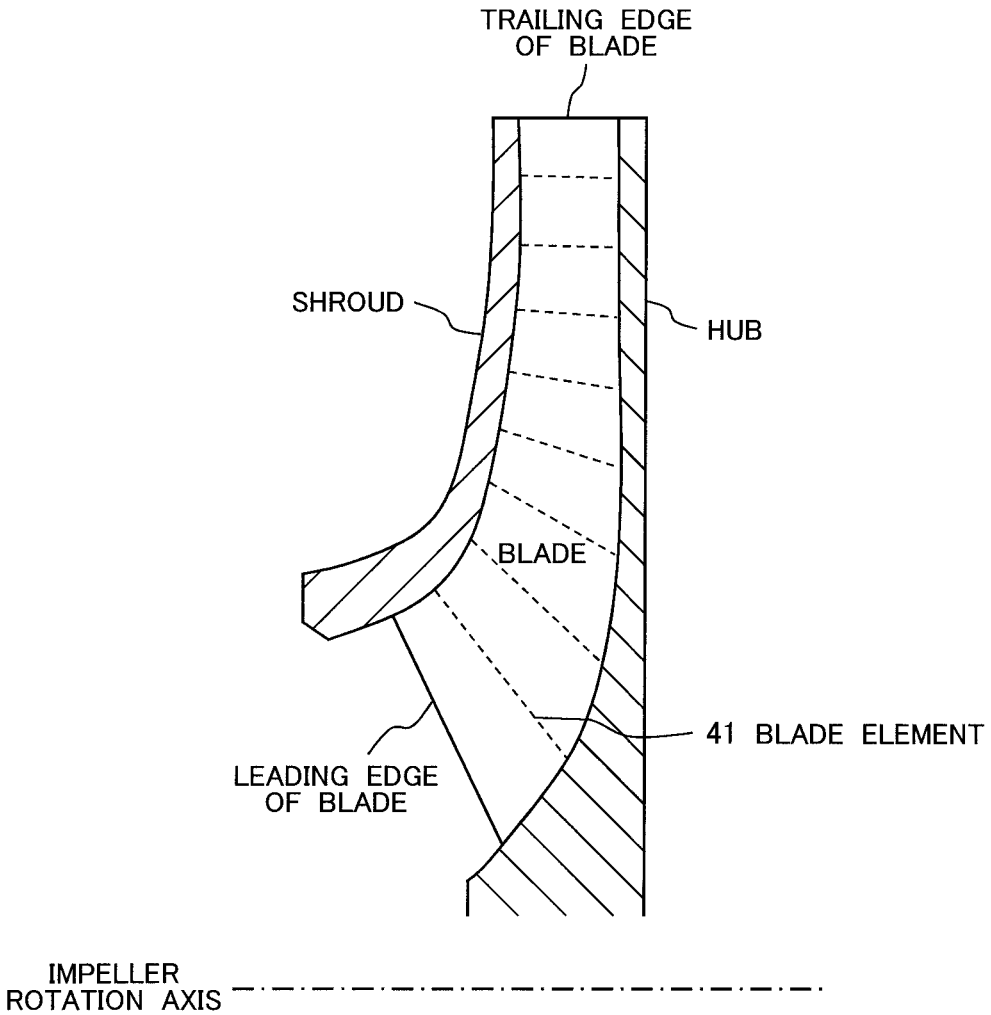
FIG. 7 is a diagram for explaining, based on a meridian plane diagram, blade elements of a centrifugal impeller.

FIG. 7 shows a centrifugal impeller blade projected on a meridian plane (a plane crossing the rotary shaft of the impeller to be parallel to the rotary shaft). Each of the broken lines drawn on the blade in FIG. 7 connects, on the meridian plane, a point between the leading edge and the trailing edge of the hub and a point between the leading edge and the trailing edge of the shroud with the two points being equal in terms of flow-direction position ratio and is defined as a blade element 41.

Figure 8:
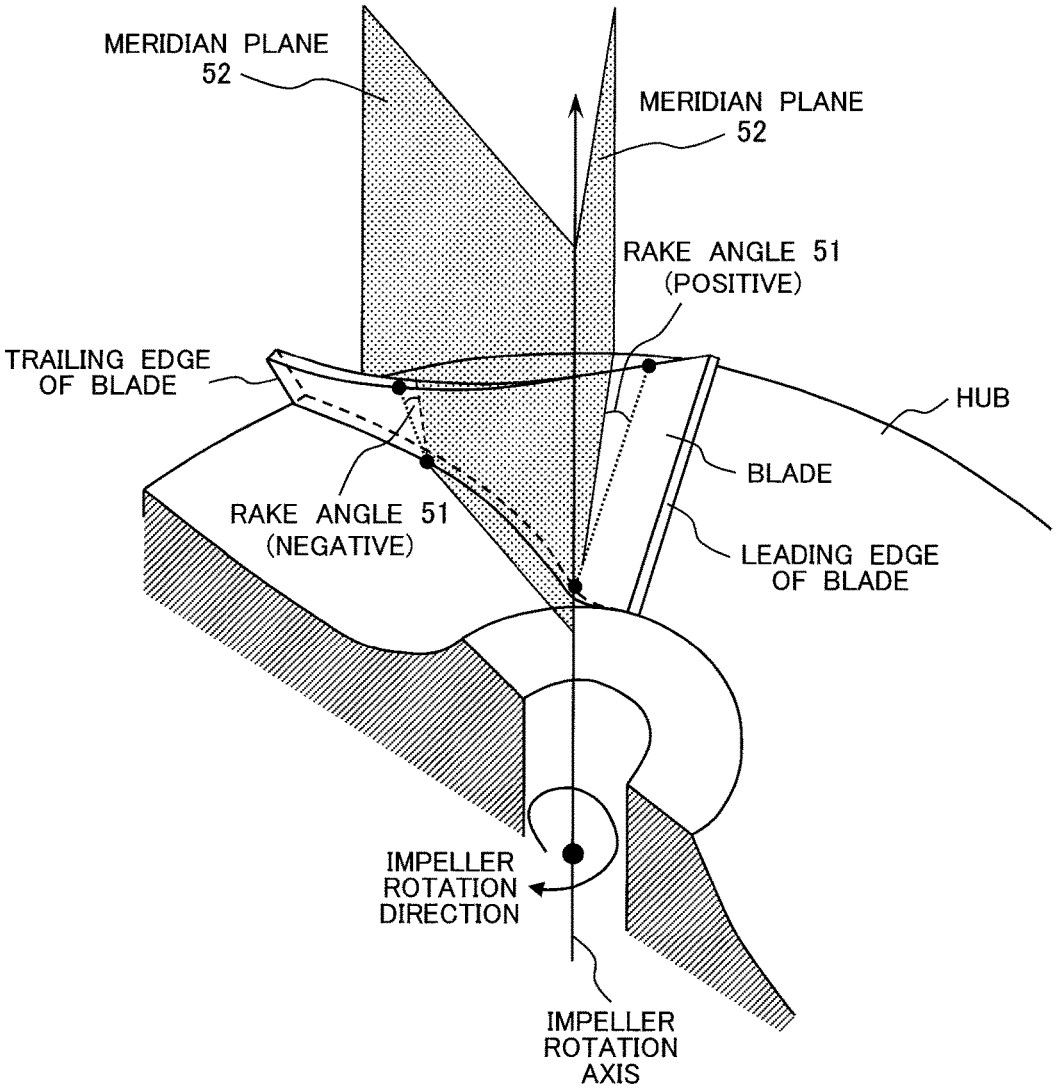
FIG. 8 is a diagram for explaining rake angles.

FIG. 8 is for describing the rake angle. As shown in FIG. 8, a rake angle 51 is an angle formed between a blade element and a line of intersection between a meridian plane 52 passing the hub-side point of the blade element and the blade including various portions. A rake angle formed with the blade element being ahead of the meridian plane in the impeller rotation direction is defined as a positive rake angle, whereas a rake angle formed with the blade element being behind the meridian plane in the impeller rotation direction is defined as a negative rake angle.

Figure 9:
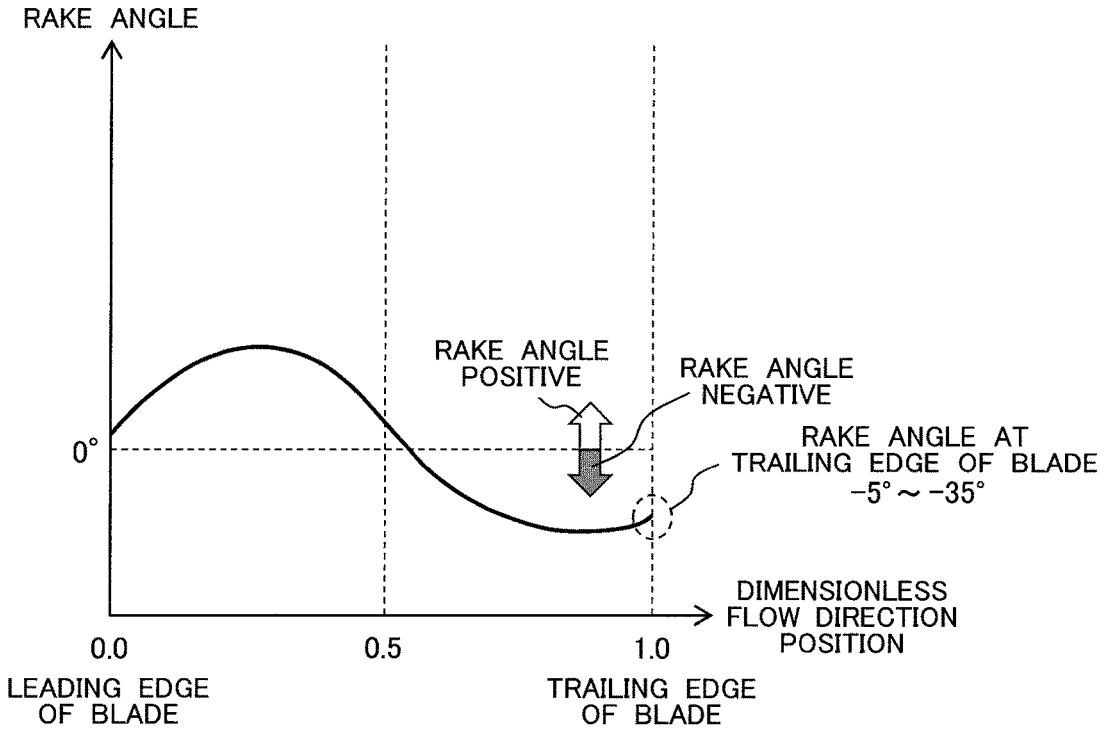
FIG. 9 is a diagram showing a rake angle distribution in the centrifugal fluid machine according to the first example of the present invention.

In the present example, the rake angle defined above reaches a maximum value between the leading edge of each blade and a middle point of the blade in the flow direction and, after reaching the maximum value, decreases on the downstream side. FIG. 9 shows the rake angle distribution in the flow direction. The horizontal axis represents dimensionless flow direction position on a meridian plane with the leading edge of the blade corresponding to 0 and the trailing edge of the blade corresponding to 1. The vertical axis, on the other hand, represents the rake angle value. The present example in which the rake angle is distributed as described above has the following effects.

As stated above, in the present example, a large bending stress is applied to the root of each blade in a leading edge portion of the impeller blade. The bending stress is larger when the blade inclination is larger, i.e. when the rake angle is larger in absolute value. It is, therefore, advisable to make the rake angle in a leading edge portion of each blade as small as possible. On the other hand, to make the overlapping portion between adjacent blades large with an aim of causing a flow separation/stall to occur preferably on the low flow rate side rather than on the high flow rate side in the impeller, it is advisable to make the positive rake angle in a forward part of each blade as large as possible. Taking the above into consideration and shaping each blade such that, as shown in FIG. 9, the rake angle reaches a maximum value between the leading edge of each blade and a middle point of the blade in the flow direction makes it possible to make the rake angle relatively small at the leading edge of the blade subjected to a large bending stress while making the overlapping portion between adjacent blades large by making the positive rake angle large on the downstream side. In this way, the effects of maintaining the strength of the leading edge portion of each blade and inhibiting the occurrence of a flow separation/stall in the impeller can both be achieved.

Also, in the present example, with an aim of reducing the secondary flow loss in the impeller, each impeller blade is shaped such that the rake angle gradually decreases in a trailing half portion of the impeller to eventually assume a negative value. In designing the blade shape, while giving consideration to the manufacturability of the trailing edge portion of the blade and the bending stress, numerical analysis was made to determine a rake angle range which can achieve an effect of reducing the secondary flow loss. As a result, the rake angle range in the trailing edge portion of the impeller blade has been set to −5° to −35°.

As described above, in the present example, it is possible to, while reducing the secondary flow loss in the impeller, inhibit, when the flow rate decreases, the occurrence of a flow separation/stall on the shroud-side suction surface at around the leading edge of each impeller blade and to, thereby, maintain the operating range of the impeller, so that a centrifugal fluid machine including an impeller having adequate strength and manufacturability can be provided.

Example 2

In the following, a second example of the centrifugal fluid machine according to the present invention will be described.

Figure 10:
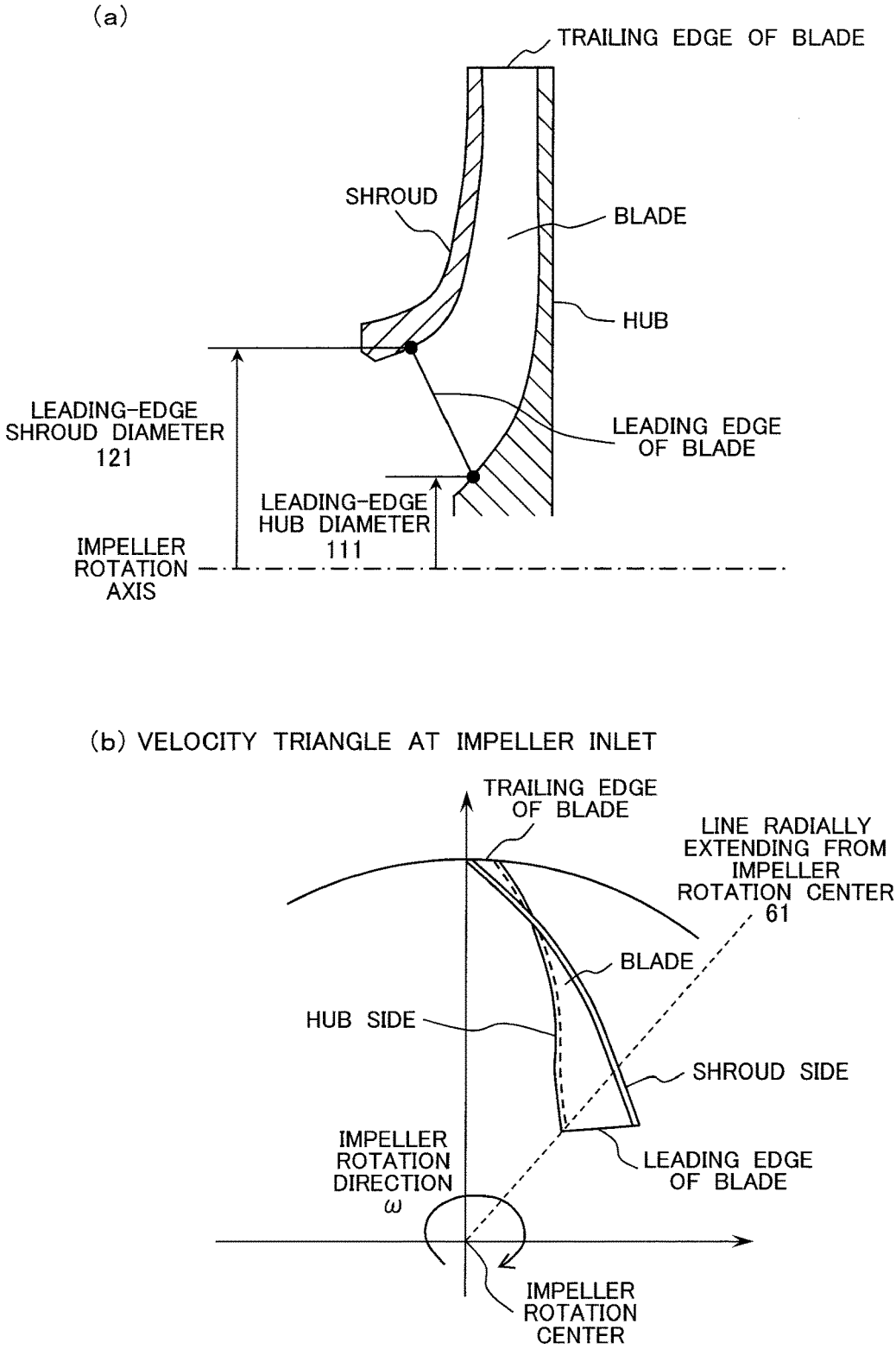
FIG. 10 is a diagram showing the shape of an impeller blade included in the centrifugal fluid machine according to a second example of the present invention.

The centrifugal fluid machine of the present example including constituent elements (impeller, diffuser, return channel, etc.) similar to those of the first example is structured as follows. In the impeller, the shroud diameter 121 is larger than the hub diameter 111 at the leading edges of the blades as shown in FIG. 10 (*a*). Also in the impeller, as shown in FIG. 10 (*b*), the shroud side of each impeller blade is, in a trailing edge portion of the impeller blade, rearwardly inclined as viewed from the upstream direction (suction direction) along the rotary shaft more than the hub side of the impeller blade. Furthermore, at the leading edge of each impeller blade, the shroud side of the impeller blade is, with respect to line 61 radially extending from the rotation center of the impeller, aligned with or ahead of the hub side of the impeller blade in the rotation direction.

In the above structure, the shroud side of each impeller blade is rearwardly inclined in the rotation direction more than the hub side thereof in a trailing edge portion of the blade. This changes the direction of blade force applied to the fluid, thereby causing the static pressure distribution between blades to change. As a result, the secondary flow usually formed to accumulate low-energy fluid on the shroud-side suction surface of each blade is suppressed, so that the secondary flow loss can be reduced.

Next, the effects generated by making the shroud diameter larger than the hub diameter at the leading edges of the blades and keeping, at a leading edge of each impeller blade and with respect to a line radially extending from the rotation center of the impeller, the shroud side of the impeller blade aligned with or ahead of the hub side of the impeller blade in the rotation direction will be described in the following.

First, the effects generated by keeping, at a leading edge of each impeller blade and with respect to a line radially extending from the rotation center of the impeller, the shroud side of the impeller blade aligned with or ahead of the hub side of the impeller blade in the rotation direction will be described in the following. Keeping the above relationship between the shroud side and the hub side of each impeller blade makes it possible to lengthen the blade length on the shroud side. Therefore, the blade loading per unit blade length is reduced, and the blade surface static pressure rise per unit blade length decreases. Thus, even with the trailing edge of each impeller blade inclined so that the shroud side of the impeller blade is positioned more backward in the rotation direction than the hub side thereof around the trailing edge thereof, it is possible to reduce the static adverse pressure gradient on the shroud-side suction surface of each blade along the main flow direction in the impeller. This makes it possible to maintain or enlarge the operating range of the centrifugal fluid machine.

However, in a state in which, as in the known examples described in PTL 2 or PTL 3, the shroud diameter and the hub diameter at the leading edges of the blades are approximately the same, performance degradation may possibly occur as described below even if, as in the present example, the shroud side at a leading edge of each impeller blade is kept aligned with or ahead of the hub side of the impeller blade.

Figure 11:
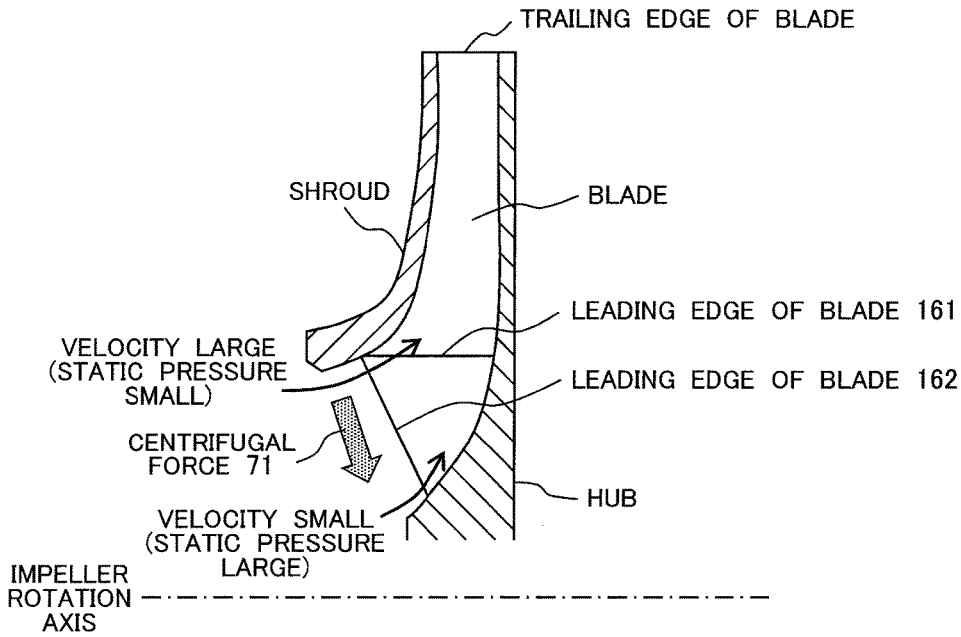
FIG. 11 is a diagram for explaining the shape, on a meridian plane, of the leading edge of an impeller blade included in a centrifugal fluid machine and for explaining the velocity in the meridian plane direction around a forward part of the impeller blade.

FIG. 11 is a sectional view on a meridian plane of an impeller for describing the flow velocity in the meridian plane direction in a forward part of each impeller blade. As shown, in a forward part of the blade, the shroud side of the blade is larger in curvature on the meridian plane than the hub side thereof, and the flow coming into the impeller is subjected to a centrifugal force in the direction denoted by 71 in FIG. 11. Therefore, on the hub side around the impeller inlet, the static pressure rises causing the velocity in the meridian plane direction to decrease. On the shroud side of the impeller inlet, on the other hand, the static pressure decreases causing the velocity in the meridian plane direction to increase.

Figure 12:
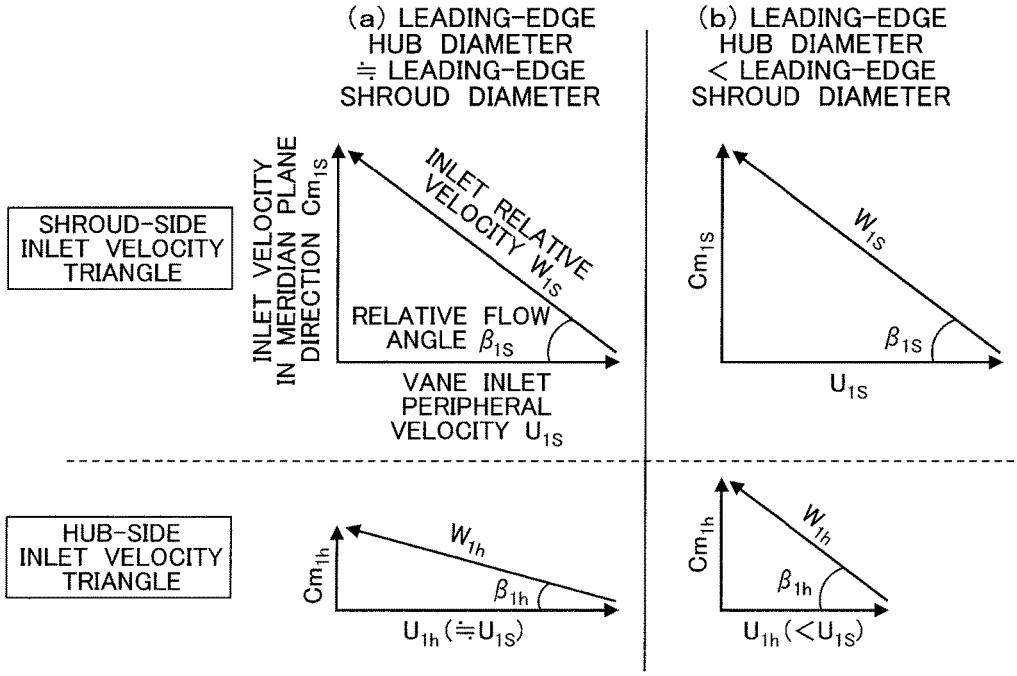
FIG. 12 compares impeller inlet velocity triangles on centrifugal fluid machines differing in terms of the hub diameter and shroud diameter at impeller blade inlets.

FIG. 12 shows velocity triangles plotted on both the shroud and hub sides of each impeller blade inlet taking into consideration the above-described velocity distribution in the meridian plane direction at around the impeller inlet. FIG. 12 (*a*) shows an inlet velocity triangle in a case in which the shroud diameter and the hub diameter at the leading edges of the blades are approximately equal in an impeller (equivalent to leading edge of blade 161 shown in FIG. 11). FIG. 12 (*b*) shows an inlet velocity triangle in a case in which the shroud diameter at the leading edges of the blades is larger than the hub diameter in an impeller (equivalent to leading edge of blade 162 shown in FIG. 11).

As shown in FIG. 12 (*a*), in the case where the shroud diameter and the hub diameter at the leading edges of the blades are approximately equal in the impeller, the blade inlet peripheral velocity on the shroud side $U_{1s}$ and the blade inlet peripheral velocity on the hub side $U_{1h}$ are approximately equal. As for the inlet velocity in the meridian plane direction, however, the shroud-side value $Cm_{1s}$ becomes larger than the hub-side value $Cm_{1h}$ as described above. Therefore, as shown in FIG. 12 (*a*), the flow angle $\beta_{1h}$ with respect to the impeller on the hub side is greatly reduced relative to the flow angle $\beta_{1s}$ with respect to the impeller on the shroud side.

Figure 13:
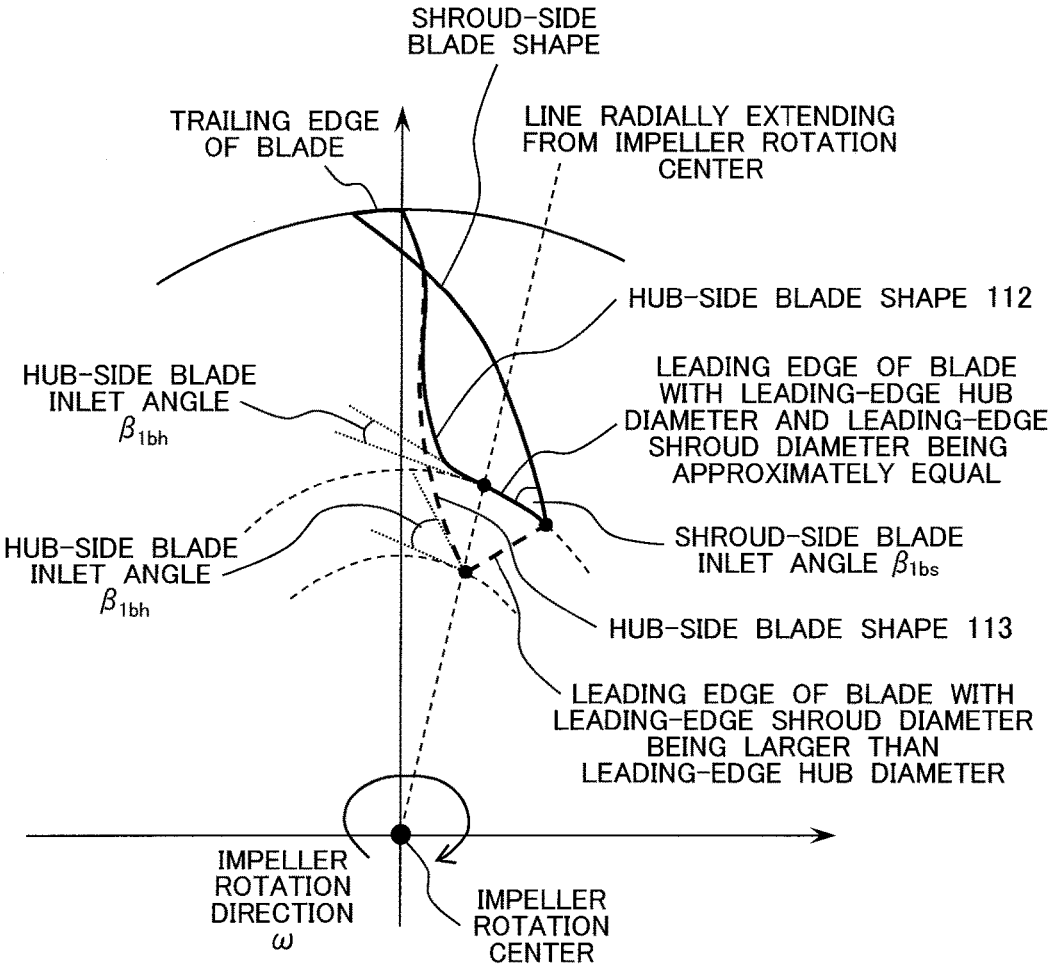
FIG. 13 compares blade shapes on the hub side in cases differing in terms of the hub diameter and shroud diameter at impeller blade inlets of the centrifugal fluid machine according to the second example.

In many cases of designing an impeller blade, the value of blade inlet angle $\beta_{1b}$ less relative inlet flow angle $\beta_1$, i.e. blade incidence angle $i_1$, is set to be approximately equal between the hub side and the shroud side. Therefore, when the shroud diameter and the hub diameter at the leading edges of the blades are made approximately equal, the blade inlet angle on the hub side $\beta_{1bh}$ becomes much smaller than the blade inlet angle on the shroud side $\beta_{1bs}$. Also, when the shroud diameter and the hub diameter at the leading edges of the blades are made approximately equal, the radial length of the hub side of each blade becomes shorter. Therefore, if, as shown in FIG. 13, the shroud side of each impeller blade is rearwardly inclined in the rotation direction more than the hub side thereof in a trailing edge portion of the impeller blade while the shroud diameter and the hub diameter at the leading edges of the blades are made approximately equal, the hub-side blade angle becomes small in a leading edge portion of the blade, so that the blade is shaped almost along the peripheral direction as denoted by numeral 112 in FIG. 13, whereas, in a downstream portion of the blade, the blade angle sharply increases. In the blade portion where the blade angle sharply increases, the fluid flowing in the impeller is sharply decelerated in the direction along the blade. On the suction surface of the blade, in particular, the fluid flow being unable to overcome the pressure gradient in the flow direction breaks away to cause efficiency degradation. Since, as shown in FIG. 11, the static pressure is higher on the hub side than on the shroud side in a forward part of each blade, the fluid having lost kinetic energy near the blade surface in the blade portion where the fluid is sharply decelerated is caused to flow in the direction of the static pressure gradient, that is, from the hub side to the shroud side. As a result, the accumulation of low-energy fluid on the shroud-side suction surface of the blade is promoted. This makes it difficult to achieve the effect of inhibiting the occurrence of a flow separation on the shroud-side suction surface at around the leading edge of the blade even if the shroud side at the leading edge of the blade is kept aligned with or ahead of the hub side thereof in the rotation direction and the blade length on the shroud side is increased.

When, as shown in FIG. 12 (*b*), the shroud diameter at the leading edges of the blades is made larger than the hub diameter, the blade inlet peripheral velocity on the shroud side $U_{1s}$ becomes larger than the blade inlet peripheral velocity on the hub side $U_{1h}$. As for the inlet velocity in the meridian plane direction, the shroud-side value $Cm_{1s}$ becomes larger than the hub-side value $Cm_{1h}$ as described above. Therefore, as shown in FIG. 12 (*b*), the flow angle $\beta_{1s}$ relative to the impeller on the shroud side and the flow angle $\beta_{1h}$ relative to the impeller on the hub side do not much differ from each other and, also, the blade inlet angle on the hub side $\beta_{1bh}$ and the blade inlet angle on the shroud side $\beta_{1bs}$ do not much differ from each other, either. Furthermore, in this case, the blade length in the radial direction increases on the hub side, so that, as indicated by numeral 113 in FIG. 13, no sharp increase in blade angle occurs between the leading edge of each blade on the hub side and the downstream side of the blade. Therefore, the occurrence of a flow separation/stall on the hub-side suction surface in a forward part of the blade is suppressed to maintain impeller efficiency. At the same time, the accumulation of low-energy fluid on the shroud-side suction surface of the blade is also suppressed. As a result, it becomes possible to achieve an adequate effect of inhibiting the occurrence of a flow separation/stall on the shroud-side suction surface at around the leading edge of each blade by keeping the shroud side at the leading edge of the blade aligned with or ahead of the hub side at the leading edge of the blade in the rotation direction.

The centrifugal fluid machine of the present example may be structured to also incorporate a feature described in connection with the first example such that, when the rake angle formed between a meridian plane and a blade element is defined to be positive in the direction of the impeller rotation, the rake angle reaches a maximum value between the leading edge of the blade and a middle point of the blade in the flow direction and such that, after reaching the maximum value, the rake angle decreases on the downstream side to be in the range of −5° and −35° at the impeller outlet.

Example 3

In the following, a third example of the centrifugal fluid machine according to the present invention will be described.

Figure 14:
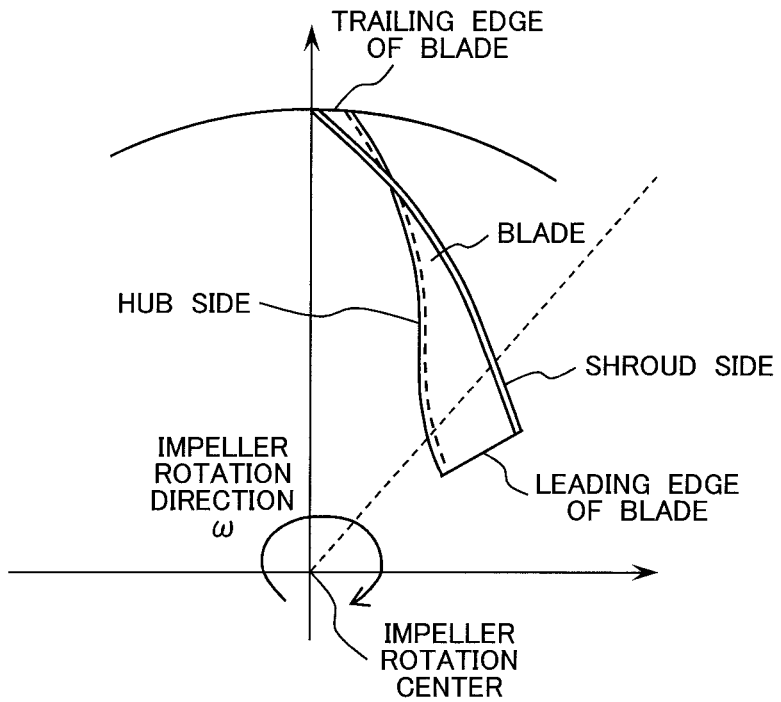
FIG. 14 is a diagram showing the shape of an impeller blade included in the centrifugal fluid machine according to a third example of the present invention.
Figure 14:
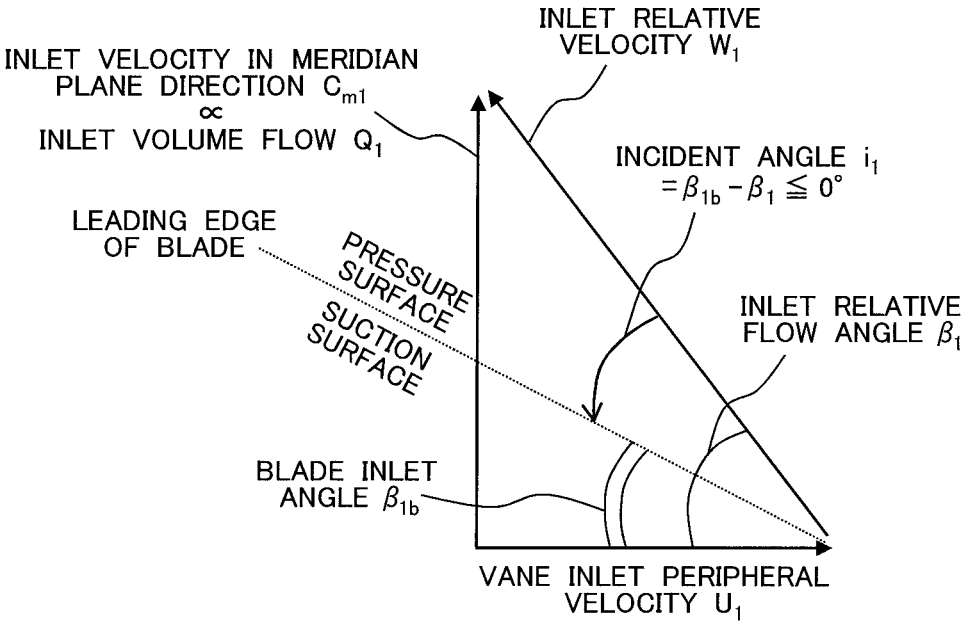

The centrifugal fluid machine of the present example including constituent elements (impeller, diffuser, return channel, etc.) similar to those of the first and second examples is structured as follows. As shown in FIG. 14 (*a*), in a portion near the trailing edge of each impeller blade, the trailing edge of each impeller blade is inclined so that the shroud side of the impeller blade is positioned more backward in the rotation direction than the hub side thereof and, as shown in FIG. 14 (*b*), the impeller incidence angle $i_1$ is set to be 0° or less at a specified point.

In the present example, at around the trailing edge of each impeller blade, the trailing edge of each impeller blade is inclined so that the shroud side of the impeller blade is positioned more backward in the rotation direction than the hub side thereof, causing, as described above, the direction in which the blade force is applied to the fluid to change and the static pressure distribution between blades to change. As a result, the secondary flow usually formed to cause low-energy fluid to accumulate on the shroud-side suction surface of the blade is suppressed, so that the secondary flow loss can be reduced.

On the other hand, making the impeller blade incidence angle $i_1$ 0° or less at a specified point generates the following effects.

As known from the impeller inlet velocity triangle shown in FIG. 14 (*b*), the blade inlet velocity $Cm_1$ in a meridian plane direction is proportional to the inlet volume flow $Q_1$, so that, as the flow rate decreases, $Cm_1$ decreases. On the other hand, the blade inlet peripheral velocity $U_1$ is constant. Therefore, as the flow rate decreases, the direction of the blade inlet relative velocity $W_1$ gradually changes and the blade inlet relative flow angle $\beta_1$ decreases. Hence, the incidence angle $i_1$ ($=\beta_{1b}-\beta_1$) of the fluid coming to the blade increases with the decrease in the flow rate. Namely, relative to the blade inlet angle $\beta_{1b}$, the inlet relative flow angle $\beta_1$ becomes gradually smaller. Therefore, as the flow rate decreases, the fluid flowing to the blade starts coming in a direction which is not along the leading edge of the blade. This makes, when the flow rate decreases to a certain value at downstream of a specified point, the incoming fluid unable to flow along the suction surface of the blade, eventually causing the flow to separate at around the leading edge of the suction surface of the blade.

The flow rate at which the flow is caused to separate at around the leading edge of the suction surface of the blade can be made smaller by making the incidence angle $i_1$ at the specified point smaller. Hence, setting the incidence angle $i_1$ to the impeller to 0° or less at the specified point makes it possible to reduce the flow rate at which the flow is caused to separate or stall at around the leading edge of the suction surface of the blade even with the trailing edge of each impeller blade inclined so that the shroud side of the impeller blade is positioned more backward in the rotation direction at around the trailing edge of the impeller blade. This makes it possible to maintain the operating range of the impeller.

The centrifugal fluid machine of the present example may be structured to incorporate features described in connection with the first and second examples such that, in the impeller, the shroud diameter at the leading edges of the blades is larger than the hub diameter at the leading edges of the blades, such that, as the impeller is seen from the suction direction, the trailing edge of each impeller blade is inclined so that the shroud side of the impeller blade is positioned more backward in the rotation direction than the hub side thereof, and such that, at the leading edge of each impeller blade, the shroud side of the impeller blade is, with respect to a line radially extending from the rotation center of the impeller, aligned with or ahead of the hub side of the impeller blade in the rotation direction.

Also, the centrifugal fluid machine of the present example may be structured to incorporate a feature described in connection with the first and second examples such that, when a rake angle formed between a meridian plane and a blade element is defined to be positive in the direction of the impeller rotation, the rake angle reaches a maximum value between the leading edge of the blade and a middle point of the blade in the flow direction and such that, after reaching the maximum value, the rake angle decreases on the downstream side to be in the range of −5° and −35° at the impeller outlet.

REFERENCE SIGNS LIST

1 . . . centrifugal impeller
2 . . . rotary shaft
3 . . . diffuser
4 . . . return channel
5 . . . impeller inlet
6 . . . downstream flow path
7 . . . suction casing
8 . . . inlet guide vane
9 . . . discharge casing
11 . . . hub
12 . . . shroud
13, 131, 132 . . . impeller blade
14 . . . pressure surface of blade
15 . . . suction surface of blade
16, 161, 162 . . . leading edge of blade
17 . . . trailing edge of blade
18 . . . blade force
21 . . . overlapping portion between adjacent impeller blades
31 . . . throat plane of impeller blade
41 . . . blade element
51 . . . rake angle
52 . . . meridian plane
61 . . . line radially extending from impeller rotation center
71 . . . centrifugal force
111 . . . hub diameter at leading edges of blades
112, 113 . . . blade shape on the hub side
121 . . . shroud diameter at leading edges of blades
141 . . . hub-side pressure surface of blade
151 . . . shroud-side suction surface of blade

The invention claimed is:

1. A centrifugal fluid machine having a centrifugal impeller which includes a plurality of impeller blades each having a leading edge, a trailing edge, a shroud side, and a hub side, wherein, when the impeller is seen from a suction direction upstream of a rotary shaft of the impeller which rotates in a rotation direction to produce flow downstream from the leading edge to the trailing edge of each impeller blade, the trailing edge of each impeller blade is inclined so that the shroud side of the impeller blade is positioned more backward in the rotation direction than the hub side thereof and wherein, out of two adjacent impeller blades, the shroud side of one impeller blade trailing the other impeller blade in the impeller rotation direction overlaps with the other impeller blade at a region of the one impeller blade adjacent to the leading edge of the one impeller blade, wherein the impeller is seen from the suction direction upstream in a direction along an axis of the rotary shaft of the impeller; and having the centrifugal impeller in which a shroud diameter at leading edges of impeller blades is larger than a hub diameter at the leading edges of the impeller blades and in which, when the impeller is seen from the suction direction upstream in the direction along the axis of the rotary shaft of the impeller, the shroud side at the leading edge of each impeller blade is, with respect to a line radially extending from a rotation center of the impeller, aligned with or ahead of the hub side at the leading edge of the each impeller blade in the rotation direction.

2. The centrifugal fluid machine according to claim 1, having the impeller in which a rake angle defined to be positive in a direction of impeller rotation reaches a maximum value between the leading edge of each impeller blade and a middle point of the impeller blade in a flow direction and, after reaching the maximum value, decreases on a downstream side to be in a range of −5° to −35° at an impeller outlet, the rake angle being an angle formed between a meridian plane which crosses the rotation center of the impeller to be parallel to the rotary shaft of the impeller and a line which connects a point between a leading edge and a trailing edge of the hub on the meridian plane and a point between a leading edge and a trailing edge of the shroud on the meridian plane, the two points accounting for a same ratio in terms of their positions between the leading edge and the trailing edge of the hub and between the leading edge and the trailing edge of the shroud, respectively.

3. The centrifugal fluid machine according to claim 1, wherein the shroud side of the one impeller blade overlaps with the other impeller blade at the region of the one impeller blade adjacent to the leading edge of the one impeller blade, the region including a shroud side of the leading edge of the one impeller blade.

4. The centrifugal fluid machine according to claim 1, wherein the shroud side of the one impeller blade overlaps with the other impeller blade at the region of the one impeller blade adjacent to the leading edge of the one impeller blade, the region including a portion of the leading edge adjacent to a shroud side of the leading edge of the one impeller blade.

5. The centrifugal fluid machine according to claim 1, wherein the shroud side of the one impeller blade overlaps with the other impeller blade at the region of the one impeller blade adjacent to the leading edge of the one impeller blade, the region including a portion of the shroud side of the one impeller blade adjacent to the leading edge of the one impeller blade.

6. A centrifugal fluid machine having a centrifugal impeller in which a shroud diameter at leading edges of impeller blades is larger than a hub diameter at the leading edges of the impeller blades, in which, when the impeller is seen from a suction direction upstream of a rotary shaft of the impeller which rotates in a rotation direction to produce flow downstream from a leading edge to a trailing edge of each impeller blade, the trailing edge of each impeller blade is inclined so that a shroud side of the impeller blade is positioned more backward in the rotation direction than a hub side thereof, and in which the shroud side at the leading edge of the each impeller blade is, with respect to a line radially extending from a rotation center of the impeller, aligned with or ahead of the hub side at the leading edge of the each impeller blade in the rotation direction, wherein the impeller is seen from the suction direction upstream in a direction along an axis of the rotary shaft of the impeller.

7. The centrifugal fluid machine according to claim 6, having the impeller in which a rake angle defined to be positive in a direction of impeller rotation reaches a maximum value between the leading edge of each impeller blade and a middle point of the impeller blade in a flow direction and, after reaching the maximum value, decreases on a downstream side to be in a range of −5° to −35° at an impeller outlet, the rake angle being an angle formed between a meridian plane which crosses the rotation center of the impeller to be parallel to the rotary shaft of the impeller and a line which connects a point between a leading edge and a trailing edge of the hub on the meridian plane and a point between a leading edge and a trailing edge of the shroud on the meridian plane, the two points accounting for a same ratio in terms of their positions between the leading edge and the trailing edge of the hub and between the leading edge and the trailing edge of the shroud, respectively.

8. The centrifugal fluid machine according to claim 6, wherein, out of two adjacent impeller blades, the shroud side of one impeller blade trailing the other impeller blade in the impeller rotation direction overlaps with the other impeller blade at a region of the one impeller blade adjacent to the leading edge of the one impeller blade, wherein the impeller is seen from the suction direction upstream in the direction along the axis of the rotary shaft of the impeller.

9. A centrifugal fluid machine having an impeller in which, when the impeller is seen from a suction direction upstream of a rotary shaft of the impeller which rotates in a rotation direction to produce flow downstream from the leading edge to the trailing edge of each impeller blade, a trailing edge of each impeller blade is inclined so that a shroud side of the impeller blade is positioned more backward in the rotation direction than a hub side thereof and in which an incidence angle to the impeller is 0° or less, wherein the incidence angle is a blade inlet angle of the impeller blade minus an inlet relative flow angle at a specified point, wherein the impeller is seen from the suction direction upstream in a direction along an axis of the rotary shaft of the impeller; and wherein, out of two adjacent impeller blades, the shroud side of one impeller blade trailing the other impeller blade in the impeller rotation direction overlaps with the other impeller blade at a region of the one impeller blade adjacent to the leading edge of the one impeller blade, wherein the impeller is seen from the suction direction upstream in the direction along the axis of the rotary shaft of the impeller.

10. The centrifugal fluid machine according to claim 9, having the impeller in which a shroud diameter at leading edges of impeller blades is larger than a hub diameter at the leading edges of the impeller blades and in which, when the impeller is seen from the suction direction upstream in a direction along the axis of the rotary shaft of the impeller, the shroud side at the leading edge of each impeller blade is, with respect to a line radially extending from a rotation center of the impeller, aligned with or ahead of the hub side at the leading edge of the each impeller blade in the rotation direction.

11. The centrifugal fluid machine according to claim 10, having the impeller in which a rake angle defined to be positive in a direction of impeller rotation reaches a maximum value between the leading edge of each impeller blade and a middle point of the impeller blade in a flow direction and, after reaching the maximum value, decreases on a downstream side to be in a range of −5° to −35° at an impeller outlet, the rake angle being an angle formed between a meridian plane which crosses the rotation center of the impeller to be parallel to the rotary shaft of the impeller and a line which connects a point between a leading edge and a trailing edge of the hub on the meridian plane and a point between a leading edge and a trailing edge of the shroud on the meridian plane, the two points accounting for a same ratio in terms of their positions between the leading edge and the trailing edge of the hub and between the leading edge and the trailing edge of the shroud, respectively.

* * * * *